US007088223B2

(12) United States Patent
Neft

(10) Patent No.: US 7,088,223 B2
(45) Date of Patent: Aug. 8, 2006

(54) SOUND GENERATOR FOR A PARKING ASSISTANCE SYSTEM

(75) Inventor: Hubert Neft, Grossbottwar (DE)

(73) Assignee: Valeo Schalter und Sensoren GmbH, Bietigheim-Bissingen (DE)

( * ) Notice: Subject to any disclaimer, the term of this patent is extended or adjusted under 35 U.S.C. 154(b) by 213 days.

(21) Appl. No.: 10/469,775

(22) PCT Filed: Nov. 22, 2002

(86) PCT No.: PCT/EP02/13132

§ 371 (c)(1),
(2), (4) Date: Feb. 4, 2004

(87) PCT Pub. No.: WO03/058601

PCT Pub. Date: Jul. 17, 2003

(65) Prior Publication Data

US 2004/0113758 A1 Jun. 17, 2004

(51) Int. Cl.
*G08B 3/00* (2006.01)

(52) U.S. Cl. ..... 340/388.1; 340/932.2; 340/384.1

(58) Field of Classification Search ..... 340/388.1, 340/932.2, 384.1, 384.6, 384.73, 391.1; 381/190, 381/365, 366; 310/322, 324
See application file for complete search history.

(56) References Cited

U.S. PATENT DOCUMENTS

| | | | | |
|---|---|---|---|---|
| 2,624,226 | A * | 1/1953 | Hansen | 84/402 |
| 3,631,481 | A * | 12/1971 | Haus | 340/388.8 |
| 3,670,321 | A * | 6/1972 | Savides | 340/384.73 |
| 5,296,839 | A * | 3/1994 | Lu | 340/384.6 |
| 5,867,090 | A * | 2/1999 | Chen | 340/388.1 |
| 6,052,059 | A * | 4/2000 | Jaeger | 340/638 |
| 6,208,237 | B1 * | 3/2001 | Saiki et al. | 340/388.1 |
| 6,306,192 | B1 * | 10/2001 | Greif et al. | 55/498 |

FOREIGN PATENT DOCUMENTS

| | | |
|---|---|---|
| DE | 916 756 | 8/1954 |
| DE | 198 32 072 | 2/1999 |
| DE | 198 56 174 | 6/2000 |
| EP | 1 063 020 | 12/2000 |

* cited by examiner

*Primary Examiner*—Anh V. La
(74) *Attorney, Agent, or Firm*—Paul Vincent

(57) ABSTRACT

A sound generator, in particular for parking assistance systems for vehicles, has a housing (2) comprising a base part (4) and a top part (6), wherein the base part (4) defines a receiving space (8, 10), which can be covered by the top part (6), for receiving a diaphragm (38). The base part (4) is formed as one part together with the top part (6) via a connecting section (28), wherein the base part (4) and the top part (6) can be moved relative to each other and can be joined by a joining device (26).

26 Claims, 2 Drawing Sheets

SOUND GENERATOR FOR A PARKING ASSISTANCE SYSTEM

This application is the national stage of PCT/EP02/13132 filed on Nov. 22, 2002 and also claims Paris Convention priority of DE 102 01 232.6 filed on Jan. 09, 2002.

BACKGROUND OF THE INVENTION

The invention concerns a sound generator, in particular, for vehicle parking assistance systems, comprising a housing with a base part and a top part, wherein the base part has a space for receiving a diaphragm which can be covered by the top part. The invention also concerns a method for producing and mounting a sound generator.

Sound generators of this type are used to assist in the parking of vehicles. Towards this end, obstacles in the vicinity of the vehicle are detected by suitable sensors. If the vehicle approaches a detected obstacle beyond a minimum distance, the driver is informed via optical or acoustical displays that a minimum distance has been surpassed. Such parking assistance systems are preferably designed such that when a first minimum distance between the vehicle and the obstacle has been surpassed, the display intensity is increased if the vehicle continues to approach the detected obstacle. This may be effected e.g. by display elements whose size can vary and/or through changing signal acoustical frequencies. To further support the driver, the optical and/or acoustical display elements are positioned in the vehicle such that there is a spatial correlation between the sensors surrounding the vehicle and the respective display elements. If a sensor detects an obstacle at the rear right vehicle fender, the displaying element is the one disposed in the rear right-hand region of the passenger compartment. Depending on the desired information density, a plurality of display elements, e.g. sound generators, is required.

The conventional sound generators for parking assistance systems consist of a plurality of individual parts which must be joined with great effort. Towards this end, a sound-generating element, e.g. a diaphragm is rigidly connected to a housing and can be removed only through desoldering. Moreover, the housing has a separate lid which can be inadvertently removed from a lower housing part under the action of external forces thereby unintentionally exposing the diaphragm.

It is the underlying purpose of the present invention to provide a sound generator which is characterized by particularly simple and inexpensive production as well as high operational safety.

SUMMARY OF THE INVENTION

This object is achieved in accordance with the invention with a sound generator of the above-described type in that the base part is formed in one part with the top part via a connecting section, wherein the base part and the top part can be moved relative to each other and be joined by joining means.

The one-piece housing design permits assembly of a sound generator simply by joining two components, i.e. housing and diaphragm. The housing thereby positions a sound-generating element, e.g. a diaphragm and protects it from external influences. The proposed design simultaneously realizes both the positioning and protective functions through positioning the diaphragm in the base part and covering the diaphragm by the top part of the one-piece housing.

The housing has a connecting section disposed between the base part and the top part by means of which the base part and the top part can be moved relative to each other. The connecting section is preferably formed as a film hinge. This is advantageous in that the housing can be formed as an injection-molded part with base part, top part and film hinge in one manufacturing step. Suitable dimensioning of the film hinge guarantees a sufficiently stable material bond between the base part and the top part and the connecting section is sufficiently yielding to permit joining of the base and top parts without plastic deformation or destruction of the connecting section. In a joining process of this type, the film hinge is brought from an undeformed position in which the film hinge is disposed in a plane, into a deformed position in which portions of the hinge respectively connected to the top and base parts are disposed on top of each other.

The means for joining the base and top parts are preferably locking means. Such locking means may comprise e.g. snap connections and can be formed integrally in the housing of the sound generator in one manufacturing step. Such joints have the considerable advantage that no additional connecting elements or special tools are required to produce a reliable joint. When the locking means are formed in a sound generator housing of plastic material, suitable elements may be molded without undercuts to facilitate construction of the injection molding tool.

The connecting section and the joining means are advantageously disposed on opposite sides of the base part. This configuration holds the base part and top part together at locations with maximum mutual separation when they are joined. The connecting section, being a component of the housing, holds the base part and top part together on a first side of the housing. The joining means, in particular the locking means, hold the base part and the top part together on a second, opposite side of the housing. External opening forces can be accommodated extremely well by the housing due to the proposed configuration without separating the top part from the base part.

The diaphragm, which is inserted into the housing of the sound generator, can be advantageously formed in one piece with electric contact means. The electric contact means comprise e.g. metal tongues which are soldered to the diaphragm or which are connected to the diaphragm in another fashion. The diaphragm can therefore be introduced into the housing together with the electrical contact means, thereby avoiding the subsequent soldering of electrical contact points required in prior art.

The receiving space in the base part of the housing preferably has a diaphragm inserting region and a contact means inserting region. A region can be provided into which the diaphragm can be inserted such that it can oscillate, and a region can be formed in which the electrical contact means are disposed in a stationary and defined position to form part of an electrical connection for an externally supplied plug.

In accordance with one embodiment of the invention, the diaphragm inserting region is limited by a bottom surface and a wall surface disposed about the periphery and perpendicular to the bottom surface and has an opening, which is parallel to the bottom surface, for inserting the diaphragm. It is thereby particularly advantageous when the contour of the receiving space corresponds to the contour of the diaphragm or the contour of the diaphragm with electric contact means such that the diaphragm can be vertically inserted, parallel to the bottom surface of the diaphragm inserting region. The proposed configuration fixes the diaphragm in the housing at a plane parallel to the diaphragm and the diaphragm can be inserted into the base part of the housing through a particularly simple joining process. The joining proceeds in a direction perpendicular to the bottom surface of the diaphragm inserting region and can be easily automated, described and realized in one single joining direction. The contact means inserting region is preferably delimited by a bottom surface and two side walls disposed on the bottom surface, which preferably merge into the wall surface of the diaphragm inserting region. The proposed configuration ensures that the diaphragm and the electrical contact means are uniformly surrounded by the housing components and are thereby protected from external influences. The required space is particularly small.

The joining means and, in particular, the locking means are preferably disposed on the two side walls which delimit the contact means inserting region. This configuration permits joining the base part and top part of the housing without requiring additional joining elements. It is also particularly simple to form the locking means without undercuts in this region, thereby facilitating the design of an injection molding tool such that the tool need not have lateral sliding elements.

The contact means inserting region preferably also has a bridge which is disposed at a separation from the bottom surface between two regions of the side walls. The bridge, the two side walls and the bottom surface form an opening, with borders on all sides, for a plug which can be externally introduced and inserted through the opening to be received by the contact means inserting region. The bridge can accept forces acting on the plug and pass them into the housing without having the top part be pried away from the base part. The external plug is reliably guided with precise definition and in a manner insensitive to disturbances.

In accordance with an advantageous embodiment of the invention, the base part of the housing has means for defining the installation position of the diaphragm. These means ensure that the diaphragm can be put into the diaphragm inserting region in only one installation position thereby ensuring that the diaphragm is properly electrically contacted through connection of the electrical contact means with an externally supplied plug. The means for defining the inserting position may be formed e.g. in a transition region which is disposed between the wall surface delimiting the diaphragm inserting region and the contact means inserting region. Towards this end, the transition region is delimited by two opposite wall surfaces whose mutual separation increases in a direction extending from the bottom surface of the diaphragm inserting region towards the opening, wherein lateral guiding surfaces are provided on the diaphragm and/or the electrical contact means which are formed complementary to the opposite wall surfaces. The diaphragm and/or the electrical contact means can therefore be guided on the wall surfaces delimiting the transition region, wherein complete insertion of the diaphragm into the diaphragm inserting region is possible only when the diaphragm is in a correct installation position.

The top part of the sound generator housing preferably has at least one sound exit opening and at least one mounting means for mounting the sound generator to an external carrier. The mounting means may be formed integrally with the top part and can be produced together with the housing in one manufacturing step e.g. by injection molding. As a result of the mounting of the mounting means on the top part of the sound generator, the base part is held by the top part after joining the top part and base part and mounting the sound generator on an external carrier. Flipping or prying off the top part from the base part is only possible when the mounting means have been previously removed from the external carrier. The top part surrounds the base part, its diaphragm inserting region, and its contact means inserting region which are thereby protected from external influences.

The mounting means can be formed as tabs, locking, or clamping means depending on the location where the sound generator is to be mounted. When the mounting means are formed as tabs, additional connecting elements such as e.g. screws can be guided through and screwed into an external carrier material e.g. a steel sheet. If the external carrier is also made from plastic material, it may be advantageous to join the sound generator to an external carrier using locking or clamping means. Towards this end, the external carrier and the sound generator may carry suitable locking or clamping means.

The surfaces of the mounting means facing the external carrier may be co-planar with the bottom surface of the base part or be slightly separated from that bottom surface. The bottom surface of the base part thereby abuts a support surface of the external carrier and is therefore fixed relative to the external carrier. Fixing of the base part onto the external carrier is improved when the surfaces of the mounting means facing the external carrier are slightly separated from the bottom surface of the base part. When the sound generator is mounted to the external carrier, a slight force is applied to the mounting means thereby firmly pressing the base part, via the top part, against the support surface and onto the external carrier.

The base part advantageously has at least one spacer for separating the diaphragm, disposed in the diaphragm inserting region, from the bottom surface of the diaphragm inserting region. This ensures that the diaphragm can oscillate freely within the diaphragm inserting region to thereby also oscillate the air surrounding the diaphragm. The top part preferably has at least one fixing means which fixes the diaphragm between the fixing means and the bottom surface of the diaphragm inserting region or the at least one spacer, when the top part and base part are joined. This configuration prevents motion of the diaphragm relative to the housing and associated e.g. disturbing rattling noises. The mechanical load due to impacts and vibrations is also considerably reduced. The spacers and/or fixing means may be formed as projections or noses in the base part or top part of the housing and can be produced, without undercuts, together with the housing in one production step.

The housing is advantageously made from plastic material and is produced by injection molding. The molding tool provided therefor preferably consists of a basic mold and exchangeable inserts wherein the shape and/or at least one of the dimensions of the at least one mounting means and/or the contact means inserting region can be alternatively formed by the exchangeable portions of the molding tool. The division of the tool into a basic mold and exchangeable inserts permits production of a plurality of different sound generator houses using one tool. The interface between the sound generator and external elements can, in particular, be adjusted to the respective conditions of use, i.e. the forming of the mounting means and the contact means inserting region. Limited mass production is thereby less expensive in certain cases. A new application may only require construction and production of an exchangeable insert for a certain mounting means or an exchangeable insert for a newly designed contact means inserting region without having to change the design of the basic tool.

The invention also concerns a method for mounting a sound generator, wherein the sound generator is produced by the following steps:

A one-part housing with base part and top part is initially provided; a diaphragm with electrical contact means is then inserted into the receiving space of the base part of the housing; and, finally, the top part and base part are joined.

These method steps are easy to automate, in particular, when the diaphragm is inserted into the receiving space in a vertical direction, parallel to the bottom surface.

Further advantageous embodiments and details of the invention can be extracted from the following description which illustrates and explains the invention in more detail with respect to the embodiments shown in the drawing.

DESCRIPTION OF THE PREFERRED EMBODIMENT

Figure 1:
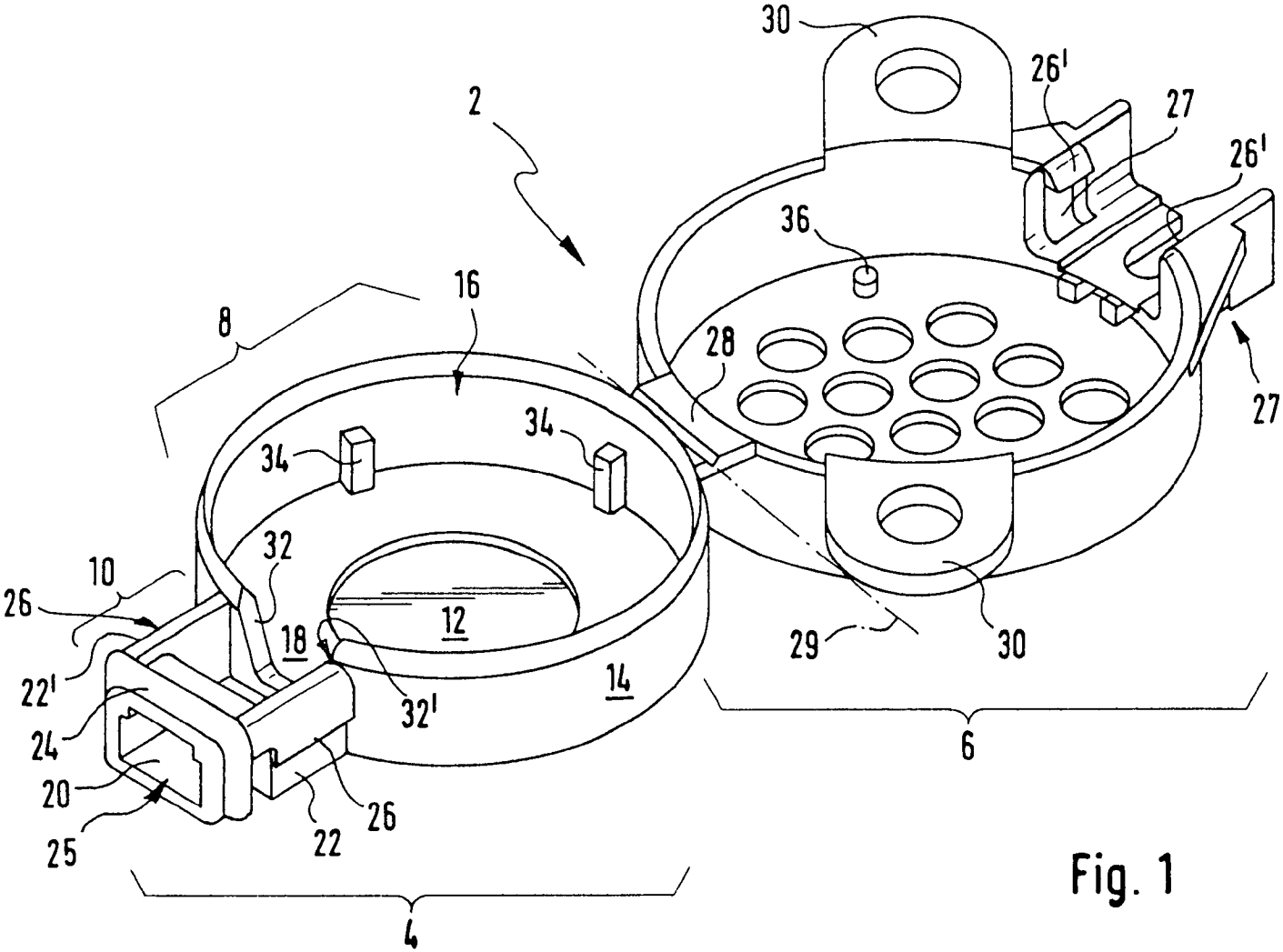
FIG. 1 shows a perspective view of a housing of an inventive sound generator.

FIG. 1 shows a housing 2 of an inventive sound generator made from plastic material having a base part 4 and a top part 6. The base part 4 has a diaphragm inserting region 8 and a contact means inserting region 10. The diaphragm inserting region 8 has a bottom surface 12, a wall surface 14 which is disposed around the periphery of and perpendicular to the bottom surface 12 and an opening 16 for inserting a diaphragm 38 (see FIG. 2). The wall surface 14 has a transition region 18 towards the contact means inserting region 10. The contact means inserting region 10 is formed from a bottom surface 20, two side walls 22, 22' and a bridge 24. The bridge 24 extends between the side walls 22, 22' and is separated from the bottom surface 20. An external plug (not shown) can be inserted through the opening 25 formed by the bottom surface 20, the side walls 22, 22' and the bridge 24. The contact means inserting region 10 is formed such that electrical contact means 40 (see FIG. 2), which are connected to the diaphragm 38 to be inserted into the diaphragm inserting region 6, can be inserted to provide an electrical connection to the external plug.

The side walls 22, 22' of the contact means inserting region 10 have locking means 26. The locking means 26 of the base part 4 can cooperate with locking means 26' of the top part 6. The projections of the locking means 26 are thereby located to engage the projections of the locking means 26'. The locking means 26' are formed such that they can be produced without undercuts. Towards this end, the top part 6 has corresponding openings 27.

The top part 6 is connected to the base part 4 via a film hinge 28. When the base part 4 and top part 6 are joined by pivoting about a pivot axis 29, a connection is provided via the film hinge 28 and the locking means 26, 26'. The top part 6 has means 30 for mounting the top part 6 with included base part 4 to an external carrier (not shown). In the embodiment of FIG. 1, the mounting means 30 are formed as tabs for receiving mounting screws.

The base part 4 and the top part 6 have further elements for defining the installation position of a diaphragm. The base part 4 has operational surfaces 32, 32' which delimit the wall surface 14 and form the transition region 18 wherein the operational surface 32 extends at an angle with respect to a direction perpendicular to the bottom surface 12 of the diaphragm inserting region 8. The operational surface 32 cooperates with a complementary surface 42 on the diaphragm 38. The diaphragm 38 may thereby be inserted into the base part 4 only in one installation position. The base part 4 also has spacers 34 which separate the diaphragm 38 from the bottom surface 12. The top part 6 has fixing means 36 for fixing a diaphragm 38, disposed on the spacers 34, when the top part 6 and the base part 4 are joined.

Figure 2:
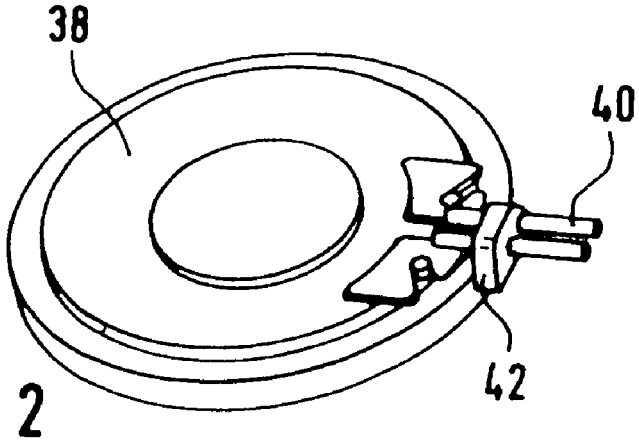
FIG. 2 shows a perspective view of a diaphragm with electrical contact means.

FIG. 2 shows a diaphragm 38 with electrical contact means 40. The electrical contact means 40 are connected to the diaphragm 38 through an operational surface 42 which can cooperate with the operational surface 32 in the base part 4 of the housing 2. The operational surface 42 extends at an angle with respect to a direction perpendicular to the diaphragm 38 and is shaped to be complementary to the operational surface 32. The cooperation between the operational surfaces 32 and 34 permits insertion of the diaphragm 38 into the diaphragm inserting region 8 formed in the base part 4 only in one inserting position, thereby bringing the electrical contact means 40, which are inserted in the contact means inserting region 10 and connected,to the diaphragm 38, into a defined position relative to the housing 2 of the sound generator. This prevents improper alignment thereby allowing proper electrical connection to an externally supplied plug.

The diaphragm 38 shown in FIG. 2 with electrical contact means 40 can be inserted into the base part 4 such that the diaphragm 38 is inserted in the diaphragm inserting region 8 and the electrical contact means 40 is inserted in the contact means inserting region 10. The diaphragm 38 with the contact means 40 can thereby be introduced in a direction perpendicular to the bottom surfaces 12, 20, wherein the diaphragm extends substantially parallel to the bottom surfaces 12, 20. The base part 4 and the top part 6 are joined by pivoting the top part 6 and the bottom part 4 about the pivot axis 29 wherein the locking means 26 engage the locking means 26'.

Figure 3:
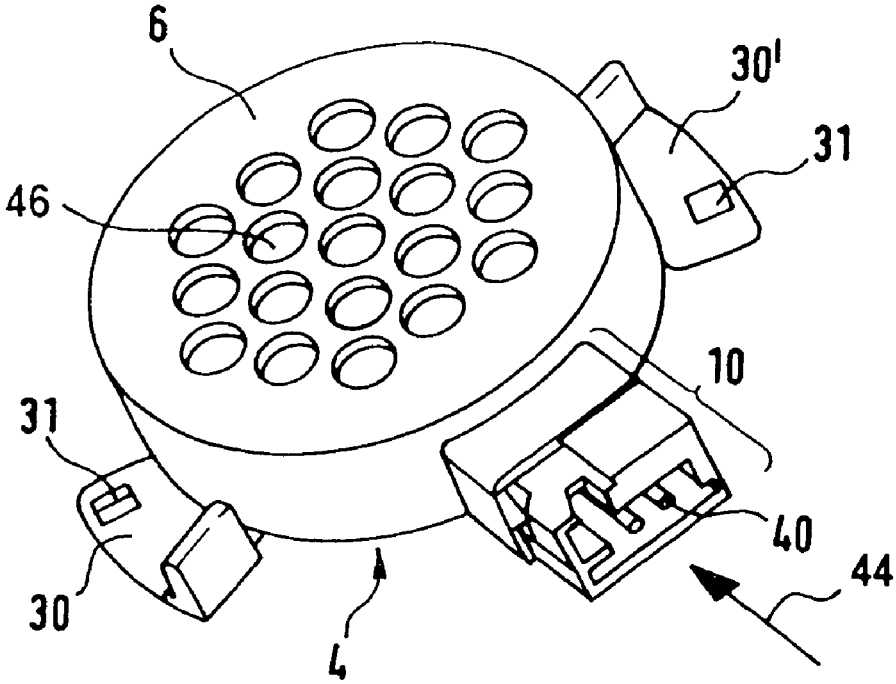
FIG. 3 shows an inventive sound generator in its assembled state.

FIG. 3 shows a second inventive sound generator in the assembled state. The sound generator may be mounted to an external carrier (not shown) via mounting means 30'. The mounting means 30' of this sound generator are formed as locking means having openings 31 in which locking means (not shown), which are connected to an external carrier or are formed on the carrier, can engage. Since the mounting means 30' are formed on the top part 6, the base part 4 is held on an external carrier by the top part 6 when the sound generator is mounted. The top part 6 can only be released from the base part 4 when the sound generator has been removed from the external carrier by releasing the mounting means 30'.

The diaphragm 38 is electrically connected by insertion of a plug (not shown) in the direction of the arrow 44. The plug and the electrical contact means 40 inserted into the contact means inserting region 10 can form an electric connection. The diaphragm 38 disposed inside of the housing 2 can emit signal tones into the surroundings of the sound generator via sound exit openings 46 provided in the top part 6.

I claim:

1. A housing for a sound generator, the sound generator having applications including use in parking assistance systems for vehicles, the sound generator having a sound generating diaphragm, the housing comprising:

a base part having a receiving space for receiving the diaphragm, said base part comprising first joining means;

a top part dimensioned to cover said receiving space, said top part comprising second joining means structured and dimensioned to cooperate with said first joining means in a closed configuration of the housing; and a flexible connection section disposed between and integrally joining said base part to said top part, wherein the flexible connection is bent to open and close the housing, wherein said top part has at least one mounting means for mounting the sound generator housing to an external carrier, said mounting means being structured and dimensioned to capture said base part between said top part and the external carrier when the sound generator is mounted to the external carrier.

2. The sound generator housing of claim 1, wherein said connecting section is a film hinge.

3. The sound generator housing of claim 1, wherein said first and said second joining means define locking means.

4. The sound generator housing of claim 1, wherein said connecting section and said first joining means are disposed on opposite sides of said base part.

5. The sound generator housing of claim 1, wherein the sound generator comprises electrical contact means integral with the diaphragm.

6. The sound generator housing of claim 5, wherein said base part defines a receiving space having a diaphragm inserting region and a contact means inserting region.

7. The sound generator housing of claim 6, wherein said diaphragm inserting region is delimited by a first bottom surface and a wall surface disposed about a periphery of and perpendicular to said first bottom surface, said diaphragm inserting region having an opening parallel to said first bottom surface for inserting the diaphragm.

8. The Sound generator housing of claim 7, wherein said receiving space has a shape corresponding to a shape of a diaphragm with contact means, wherein the diaphragm can be inserted vertically, parallel to said first bottom surface of said diaphragm inserting region.

9. The Sound generator housing of claim 7, wherein said contact means inserting region is delimited by a second bottom surface and two side walls disposed on said second bottom surface.

10. The sound generator housing of claim 9, wherein said two side walls merge into said wall surface of said diaphragm inserting region.

11. The sound generator housing of claim 9, wherein said first joining means are disposed on said two side walls.

12. The sound generator housing of claim 9, wherein said contact means inserting region has a bridge which is disposed at a separation from said second bottom surface, between said two side walls.

13. The sound generator housing of claim 1, wherein said base part has means for defining an inserting position of the diaphragm.

14. The sound generator housing of claim 7, wherein said wall surface delimiting said diaphragm inserting region has a transition region to said contact means inserting region.

15. The sound generator housing of claim 14, wherein said transition region is delimited by two opposite wall surfaces whose mutual separation increases from said first bottom surface of said diaphragm inserting region towards said opening, wherein at least one of the diaphragm and the electrical contact means have lateral guiding surfaces which are complementary to said two opposite wall surfaces.

16. The sound generator housing of claim 1, wherein said top part has at least one sound exit opening.

17. The sound generator housing of claim 1, wherein said at least one mounting means is formed as one of a tab, a locking means, and a clamping means.

18. The sound generator housing of claim 1, wherein surfaces of said mounting means facing the external carrier are co-planar with a first bottom surface of said base part.

19. The sound generator housing of claim 1, wherein surfaces of said mounting means facing the external carrier are slightly spaced from a first bottom surface of said base part.

20. The sound generator housing of claim 1, wherein said base part has at least one spacer through which the diaphragm is spaced apart from said first bottom surface of said base part.

21. The sound generator housing of claim 1, wherein said top part has means for fixing the diaphragm between said means for fixing and a first bottom surface of said base part or a spacer, when said top part and base part are joined.

22. A method for producing the sound generator housing of claim 1, wherein the housing is injection molded from plastic material.

23. The method of claim 22, wherein the sound generator housing is produced by injection molding using a casting tool which has a basic form and exchangeable inserts, wherein at least one of a shape and dimensions of at least one of said base part and said top part can be changed in the casting tool via said exchangeable inserts.

24. The method of claim 23, wherein said top part has at least one mounting means for mounting the sound generator housing to an external carrier, the sound generator having electrical contact means integral with the diaphragm, wherein at least one of said mounting means and a contact means insertion region can be changed in said casting tool via said exchangeable inserts.

25. A method for mounting a sound generator in the housing of claim 1, the method comprising the steps of:

a) providing a one-part housing having a base part, a top part, and a flexible connection section disposed between and connecting said base part and said top part;

b) inserting a diaphragm having electrical contact means into a receiving space of said base part of the housing; and c) joining said top part and said base part of the housing.

26. The method for mounting a sound generator of claim 25, wherein the diaphragm is inserted vertically into said receiving space, parallel to a bottom surface of said base part.

* * * * *